US005384364A

United States Patent [19]

Besse et al.

[11] Patent Number: 5,384,364

[45] Date of Patent: Jan. 24, 1995

[54] STABILIZED DETERSIVE-SYSTEM CONTAINING WATER SOLUBLE FILM ARTICLE

[75] Inventors: Michael E. Besse, Golden Valley; Deborah A. Ihns, St. Paul.; Keith E. Olson, Apple Valley, all of Minn.

[73] Assignee: Ecolab Inc., St. Paul, Minn.

[21] Appl. No.: 11,348

[22] Filed: Jan. 29, 1993

Related U.S. Application Data

[63] Continuation of Ser. No. 789,615, Nov. 8, 1991, which is a continuation of Ser. No. 548,286, Jul. 3, 1990, abandoned.

[51] Int. Cl.[6] ..... C11D 17/00; C11D 3/02; C11D 7/08

[52] U.S. Cl. ..... 252/90; 252/135; 252/174; 252/174.13; 252/174.14

[58] Field of Search ..... 252/90, 135, 174, 174.13, 252/174.14

[56] References Cited

U.S. PATENT DOCUMENTS

| | | | |
|---|---|---|---|
| 2,470,881 | 5/1949 | Hermanson | 252/90 |
| 3,186,869 | 6/1965 | Friedman | 252/90 |
| 3,198,740 | 8/1965 | Dunlop, Jr. et al. | 252/90 |
| 3,322,674 | 6/1968 | Friedman | 252/90 |
| 3,868,336 | 2/1975 | Mazzola et al. | 252/527 |
| 3,892,905 | 7/1975 | Albert | 428/220 |
| 3,979,314 | 9/1976 | Child | 252/140 |
| 4,416,791 | 11/1983 | Haq | 252/90 |
| 4,522,738 | 6/1985 | Magid et al. | 252/90 |
| 4,552,681 | 11/1985 | Koch et al. | 252/140 |
| 4,557,852 | 12/1985 | Schulz et al. | 252/95 |
| 4,654,395 | 3/1987 | Schulz et al. | 526/318.42 |
| 4,657,784 | 4/1987 | Olson | 427/213 |
| 4,747,976 | 5/1988 | Yang et al. | 252/90 |
| 4,806,261 | 2/1989 | Ciallella et al. | 252/90 |
| 4,830,773 | 5/1989 | Olson | 252/174.13 |
| 5,093,021 | 3/1992 | Coyne et al. | 252/90 |
| 5,198,198 | 3/1993 | Gladfelter et al. | 252/90 |

FOREIGN PATENT DOCUMENTS

| | | |
|---|---|---|
| 676777 | 12/1963 | Canada . |
| 0203239 | 12/1986 | European Pat. Off. . |
| 0314890 | 5/1989 | European Pat. Off. . |
| 63-12466 | of 1988 | Japan . |
| 63-12467 | of 1988 | Japan . |

OTHER PUBLICATIONS

International Search Report PCT/US91/04630, International Filing Date Jun. 28, 1991.

Database WPIL, Derwent Publications, London, GB Accession Number: 88-054705 [08] regarding Japanese patent application 63-012467 (Lion Corp.) 1988 No month available.

*Primary Examiner*—Paul Lieberman
*Assistant Examiner*—Michael P. Tierney
*Attorney, Agent, or Firm*—Merchant, Gould, Smith, Edell, Welter & Schmidt

[57] ABSTRACT

The stability of polyvinyl films used to contain detersive systems may be enhanced by the use of a barrier coating composition to separate the film degrading components, i.e., acids, bases, and halogens, from these films. The barrier coatings may either encapsulate the individual film degrading components, or they may coat the entire detersive system.

29 Claims, 1 Drawing Sheet

STABILIZED DETERSIVE-SYSTEM CONTAINING WATER SOLUBLE FILM ARTICLE

This is a continuation of application Ser. No. 07/789,615, filed Nov. 8, 1991 which is a continuation of Ser. No. 07/548,286 filed Jul. 3, 1990 now abandoned.

FIELD OF INVENTION

The invention relates to detersive systems packaged in a water soluble enclosure. More particularly, the invention relates to formulating a detersive system in the form of a particle or pellet to prevent the degradation of water soluble film packaging caused by various components of the detersive system. Detersive systems are mixtures of chemicals that can remove impurities, dirt or a soil from a surface or fabric.

BACKGROUND OF THE INVENTION

The art relating to water soluble polymeric films recognizes the use of the films in packaging. The primary commercial use of such packets has been in household applications in which pre-measured quantities of detergent materials can be packaged in water-soluble films for ease of use. Soluble packaging can also eliminate problems concerned with dusting and human contact with dust which can cause chemical attack and/or irritation of human skin and eyes and can cause other problems upon ingestion or inhalation.

Widespread use of water soluble packets containing detergent compounds has been hampered by physical and chemical compatibility of film with water and detersive systems. Many films such as polyvinyl-pyrrolidone, polyethyloxazoline and polyvinyl alcohol films can react with or interact with active components of a detersive system. Such films are known to be sensitive to moisture, which can soften the film and reduce tensile strength. However, more importantly, many of the chemicals commonly used in detergent compositions can attack the film and cause failure in the package integrity and/or water solubility especially when stored or used in humid conditions.

Researchers have attempted to alleviate PVA degradation problems by altering the film itself. Yang, et al. U.S. Pat. No. 4,747,976 discloses films comprising copolymers of 90–100% hydrolyzed vinyl alcohol with a non-hydrolyzable anionic comonomer having a viscosity range of 4–35 cP that can be used for alkaline or borate compositions. Gueldenzopf, et al. U.S. Pat. No. 4,654,395 discloses an addition polymer of a water insoluble soft monomer, a water soluble anionic monomer and optionally a water soluble nonionic monomer and water insoluble hard monomer which is neutralized to at least about 75% and formed into a sheet which can form a packet for bleaching chemicals etc.

Other attempts have been directed to using insoluble coatings to passivate the film envelope contents as shown in Lyon, Japanese Patent No. 63-012467, which discloses the use of a detergent coated with a micro fine insoluble powder enclosed in individual packets made of a water soluble film. This approach has the inherent drawback of introducing into a cleaning composition insoluble powders which can form residue on the surface after cleaning.

Therefore, a completely water soluble cleaning product free of insoluble materials that form residue is needed which is compatible with soluble polymer films and can be used in a number of cleaning applications.

SUMMARY OF THE INVENTION

It has been found that water soluble film packaging can be protected from degradation by a detersive system by dispersing a water soluble barrier about the detersive system or about the active film degrading component in the detersive system. The package comprises a water soluble film containing a particulate detersive system comprising a film degrading component and a water soluble barrier coating which is disposed on the particles to prevent the film degrading component from promoting film breakdown. The term "film degrading component" means a component that reduces the tensile strength, flexibility, solubility or clarity of the film. The film degrading components can operate by a variety of mechanisms including reducing the film molecular weight, crosslinking the film, removing or adding pendant groups to the film polymer, becoming physically or chemically a part of the film or causing other chemical or physical changes to the film. The most common film degrading components are alkalis, acids and sources of active halogen.

A method for producing a stable, water soluble package which contains a cleaning composition used for delivering a cleaning solution to a use location has also been found, which method comprises packaging a detersive system in a film, separating the film degrading component of the detersive system from the film by means of a water soluble barrier coating, wherein the water soluble barrier coating is disposed to prevent the film degrading component from promoting film breakdown.

A first aspect of the invention resides in a film envelope having a detersive system having a film degrading agent separated from the film by a barrier. A second aspect involves a detersive system with an encapsulated halogen source that can be compatible with film envelopes. A third aspect comprises a detersive system having an acid component with a micronized powder barrier coating. A last aspect comprises a detersive system having an alkaline component with a first spacing layer and a micronized powder coating.

A BRIEF DESCRIPTION OF THE DRAWING

FIG. 1 illustrates a detersive system in a water soluble package according to the invention which contains a water soluble, barrier coated detersive system.

FIG. 1*a* is an expanded view of the particles of a water soluble, barrier coated detersive system.

FIG. 2 illustrates a water soluble package according to the invention which contains a detersive system in which an active component is coated with a water soluble, barrier coating.

FIG. 2*a* is an expanded view of the particles of a detersive system comprising an encapsulated film-degrading component.

DETAILED DESCRIPTION OF THE INVENTION

Figure 1:
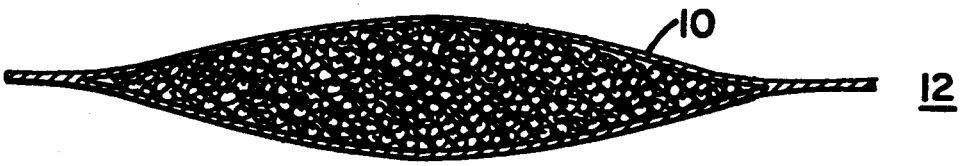

The invention concerns a detersive system contained within a soluble package comprising a water soluble film, a detersive system comprising at least one film degrading component and a water soluble barrier coating disposed about the film degrading component. This invention addresses a novel system and method of reducing or substantially preventing such component-induced film degradation using a barrier coating disposed about the film degrading component to prevent the component from promoting film degradation. The barrier coating is water soluble at the pH and temperature of the detersive solution formed upon combination of the detersive system and water.

The water soluble package is generally composed of a water soluble film which is susceptible to degradation by many chemicals useful in detersive systems. This invention addresses this problem, not by modifying the film, but by isolating the detersive system from the film. In this manner, a novel packaged detersive system is produced.

DETAILED DESCRIPTION OF THE DRAWING

Figure 1A:
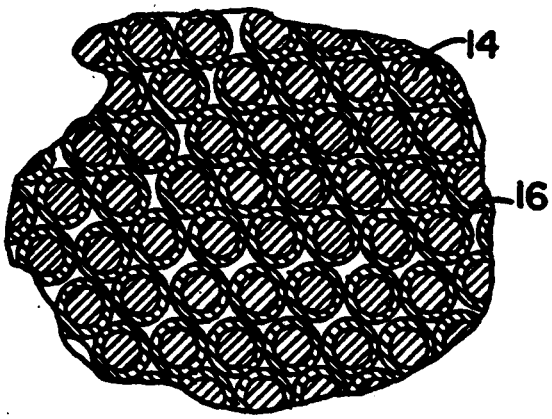

In one embodiment of the invention, as illustrated in FIGS. 1 and 1*a*, a water soluble film 10 is formed into a packet shown generally at 12. This water soluble packet 12 contains a detersive system 14 which is coated with a water soluble barrier coating 16. The packet 12 is then sealed to completely contain the detersive system 14.

Figure 2:
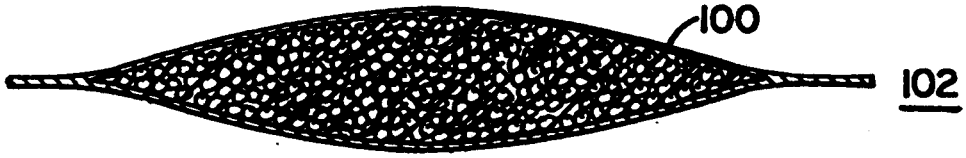
Figure 2A:
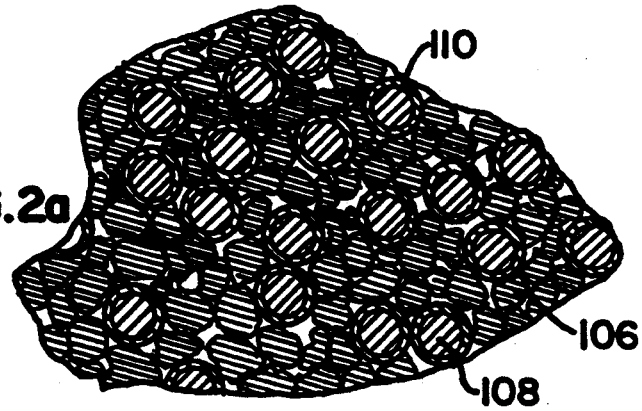

In another embodiment of my invention, as illustrated in FIGS. 2 and 2*a*, a water soluble film 100 is formed into a packet 102. The packet 102 is then charged with a detersive system 104. The detersive system is made up of two general classes of particles. The first class of particles encompasses those particles 106 which do not promote film 100 breakdown. The other class of particle encompasses those particles 108 which comprise film degrading chemicals. These particles 108 are therefore coated with a water soluble barrier coating 110 to protect the film 100. Again, the packet 102 is sealed to completely enclose the detersive system 104.

FILM

The water soluble film used to make the packet may comprise any number of water soluble films formulated from water soluble or dispersible resins. Representative, non-limiting water soluble resins include polyvinyl alcohol, polyvinyl pyrrolidone, methylcellulose, hydroxyethylcellulose, hydroxypropyl cellulose, sodium carboxymethylhydroxyethylcellulose, polyvinyl acetate, polyethyloxazoline, and film forming derivatives of polyethylene glycol.

Preferably, the film is a polyvinyl alcohol film which has adequate tensile strength and pliability under use conditions. The physical properties of PVA are controlled by molecular weight and the degree of hydrolysis. For most film applications, a molecular weight in the range of about 10,000 to about 100,000 is preferred. All commercial grades of PVA films can be dissolved in water, the only practical solvent for most cleaning purposes. The ease with which PVA can be dissolved is controlled primarily by the degree of hydrolysis which is the percent by which acetate groups of a polyvinyl acetate resin have been removed, leaving hydroxyl groups. Fully hydrolyzed products must be heated close to the atmospheric boiling point of water to completely dissolve. Lower temperatures are required as the degree of hydrolysis decreases until 75–80% hydrolysis is reached. The hydrolysis range of 86–89% is considered optimum for both cold and hot water solubility. Products with this optimum degree of hydrolysis are commonly referred to as partially hydrolyzed PVA. The hydrolysis of the acetate groups can continue in the presence of strong inorganic acids, bases and halogens which will interfere with the water solubility of the PVA film. This fact severely limits the choice of chemicals which may be included in the detergent formulation for water soluble packaging.

Preferably the polyvinyl alcohol used in the present invention has a molecular weight from about 10,000 to about 200,000, and more preferably from about 10,000 to about. 100,000. The degree of hydrolysis present in the polyvinyl alcohol of the present invention is preferably from about 80 to about 90% and most preferably from about 86 to about 89%.

Polyvinyl alcohol films used in making water soluble packages are generally manufactured in film thicknesses of about 1 to about 4 mils. Such films are readily suitable for use in the invention. Often, the films are etched or roughened to increase the surface area on one side of the film. This side of the film is then generally oriented to the outside of the film packet to allow greater surface area to be presented to the water to speed the dissolution of the PVA film. The inside of the packet is generally smooth to reduce the likelihood of the film's degradation by compositions contained therein. In the preferred embodiment, the film thickness is from about 1.0 to about 2.5 mils, and the film is etched on the side which forms the outside of the packet.

The packet dimensions will be governed by the desired use of the detersive system contained therein and the volume of detersive system required to perform such a function. For ease and efficiency in manufacture, a roughly rectangular packet is preferred.

Useful water soluble films for use in the water soluble packet include those that dissolve at a water temperature of about 1° C. to about 100° C., and more preferably from about 1° C. to about 85° C.

The packet may be made by sealing the edges of the water soluble film by any means known to those in the field of the art. Such means include the use of adhesives, ultrasonic sealing, heat sealing and water sealing. Preferably the finished packets are water sealed.

Detersive System

Generally detersive systems contain at least one cleaning agent such as soap detergent, alkaline salt or combination thereof. In the context of detersive systems, especially those designed for washing surfaces and fabrics such as dishware and laundry items, a detersive system is described as the blend of chemical agents that can remove soil by employing one or more of the following mechanisms generally in conjunction with mechanical action:

1. lowering the surface and interfacial tension of the cleaning solution made from the detersive system promoting soil removal,
2. solubilization of soils,
3. emulsification of soils,
4. suspension/dispersion of fatty soils,
5. saponification of fatty soils and enzyme digestion of proteinaceous soils,
6. inactivation of water hardness, and
7. neutralization of acid soils.

Detersive systems are concentrates that comprise a combination of ingredients that can be used primarily in dilute form in aqueous media and can act to remove soil from a substrate. The detersive systems of this invention are typically in the form of a particulate, a pellet or a larger solid mass. Particulates include products made by particle mixing, dry blending and granulation. Solids include cast solids, extrudates or compressed solids.

A detersive system typically contains a detergent which is a chemical compound that can weaken or break bonds between soil and a substrate. Organic and inorganic detergents include surfactants, solvents, alkalis, basic salts and other compounds. A detersive system is typically used in a liquid cleaning stream, spray, bath, etc. which produces an enhanced cleaning effect that is caused primarily by the presence in the bath of a special solute (the detergent) that acts by altering the interfacial effects at the various phase boundaries (i.e. between soil, substrate and both) within the system. The action of the bath typically involves more than simply soil dissolution. The cleaning of washing process in a typical detersive system usually consists of the following sequence of operations. The soiled substrate is immersed or otherwise introduced into or contacted by a large excess of a bath containing a detergent solute. The soil and the underlying object or substrate typically becomes thoroughly wetted by the bath. The system is subjected to mechanical agitation by rubbing, shaking, spraying, mixing, pumping or other action to provide a shearing action which aids in the separation of the soil from the substrate. The bath now containing the soil is typically removed from the object to be cleaned, the object is rinsed and often dried.

Detersive systems are often used in cleaning hard surfaces such as sinks, tiles, windows, and other glass, ceramic, plastic or other hard surface dishware, and laundry or other textiles. Soils removed from substrates by the detersive systems are extremely variable in composition. They may be liquid, solid or a mixture thereof. The soils typically consist of mixtures of proteinaceous, carbohydrate, and fatty materials typically in combination with inorganic components and some water.

Detersive baths typically contain a detergent which is often a organic surfactant detersive component, an inorganic detersive component, or combinations of organic and inorganic components, and can typically be used in combination with other organic and inorganic components that provide additional properties or enhance the basic detersive property of the detersive component. The compositions dissolved or suspended in water to provide detersive systems are formulated to suit the requirements of the soiled substrate to be cleaned and the expected range of washing conditions. Few cleaning systems have a single component. Formulated detersive systems consisting of several components often out-perform single component systems. Materials which can be used independently in detersive systems are as follows:

(a) surfactants including various synthetic surfactants and natural soaps;
(b) inorganic builders, diluents, or fillers including salts, acids and bases;
(c) organic builder additives which enhance detergency, foaming power, emulsifying power, soil suspension and sequestering agents which reduce the effects of hardness in service water;
(d) special purpose additives such as bleaching agents, brightening agents, enzymes, bactericides, anticorrosion agents, emollients, dyes, fragrances, etc.; and
(e) hydrotrope solubilizers used to ensure a compatible uniform mixture of components including alcoholic cosolvents, low molecular weight anionic surfactants, emulsifying agents, etc.

Organic Surfactant

Preferred surfactants are the nonionic, anionic, and cationic surfactants. Cationic surfactants such as quaternary ammonium compounds are frequently used in detersive systems but are typically not cleansing ingredients and are used for purposes such as sanitizing or fabric softening.

Soil removing surfactants can comprise soaps, i.e. (a) sodium or potassium salts of fatty acids, rosin acids, and tall oil; (b) alkylarene sulfonates such as propylene tetramerbenzene sulfonate; (c) alkyl sulfates or sulfonates including both branched and straight chain hydrophobes as well as primary and secondary sulfate groups; (d) sulfates and sulfonates containing an intermediate linkage between the hydrophobic and hydrophilic groups such as taurides and sulfonated fatty monoglycerides, long chain acid esters of polyethylene glycol, particularly a tall oil ester; (f) polyalkylene glycol ethers of alkyl phenols wherein the alkylene group is derived from ethylene or propylene oxide or mixtures thereof; (g) polyalkylene glycol ethers of long chain alcohols or mercaptans, fatty acyl diethanolamides; (h) block copolymers of ethylene oxide and propylene oxide; and others.

Preferred examples of nonionic Surfactants include the following: $C_{6-12}$ alkyl phenol ethoxylates and/or propylates, $C_{5-20}$ alcohol ethoxylates or propoxylates, EO/PO block copolymers (pluronic and reverse pluronics), or mixtures thereof.

Inorganic Compounds

Detersive systems can contain inorganic detergent compounds which are typically grouped into the following six categories: alkalis, phosphates, silicates, neutral soluble salts, acids, and insoluble inorganic builders.

Sources of alkalinity useful in the invention include but are not limited to the following: alkali metal hydroxides, alkali metal carbonates, alkali metal bicarbonates, alkali metal sesquicarbonate, alkali metal borates, and alkali metal-silicate. The carbonate and borate forms are typically used in place of alkali metal hydroxide when a lower pH is desired. Silicates ($Na_2O:SiO_2$ compounds) which are typically a reaction product between sodium hydroxide and silica, have a variety of $Na_2O:SiO_2$ reaction molar ratios. Silicates are primarily used as alkalis and as builders in both warewashing and laundry formulations.

Threshold agents can include organic and inorganic carboxylates, phosphates, phosphonates and mixtures thereof. Such agents include but are not limited to the following: organic acrylate polymers, phosphinic and phosphonic acids, inorganic phosphate compositions including monomeric phosphate compounds such as sodium orthophosphate and the higher condensed-phosphates including tetraalkali metal pyrophosphates, sodium tripolyphosphate, glassy phosphates and others. Threshold agents are typically used at low concentration, about 0 to 500 ppm, in order to slow or delay the formation of deposits of hardness components through a much less than stoichiometric reaction between the threshold agent and the inorganic components of hardness in service water. Phosphates are typically used as sequestering, suspending and cleaning agents. Sodium tripolyphosphate is the most widely used builder in heavy duty detergents.

Neutral soluble salts which are typically the reaction product of a strong acid a strong base including sodium sulfate, sodium chloride, and others can also be used in conjunction with or in combination with the detersive systems of the invention. Neutral soluble salts are typically used as builders or diluents in synthetic surfactant based detersive compositions.

Insoluble inorganic builders are often used solid, pelletized and particulate detersive systems. The insoluble inorganics including clays, both natural and synthetic, such as montmorilonite clay or bentonite clay, can have a detersive effect in certain systems.

Organic Builders and Additives

Further, the detersive systems can contain organic builders and other special purpose additives. This class of compound comprises organic molecules have little detersive nature but containing many other desirable properties including antiredeposition additives, sequestrants, antifoaming or foaming additives, whiteners and brighteners, additives or hydrotropes for maintaining the solubility of components, and additives for protecting both the substrate and the washing apparatus. The most common organic additives include organic sequestrants and organic antiredeposition agents. Organic sequestrants include compositions such as polyacrylic acid and methacrylic acid polymers, ethylene diamine tetraacetic acid, nitrilotriacetic acid, etc. and others.

Sources of Active Halogen or Chlorine

Sources of active chlorine useful the invention include but are not limited to the following: alkali metal and alkaline earth metal hypochlorite, chlorinated condensed phosphates, dichloroisocyanurate, chlorinated cyanurate, and mixtures thereof. Specific examples of active chlorine sources include the following: calcium hypochlorite, chlorinated sodium tripolyphosphate, and sodium dichloroisocyanurate dihydrate.

Common detersive systems in use today are laundry systems, industrial institutional and household dishwashing or warewashing compositions, clean-in-place and hard surface cleaning compositions. These detersive systems can all incorporate the barrier coating and film packet of the present invention.

In aqueous dishwashing, detersive solutions are prepared from typically liquid, particulate, pelletized or solid detersive systems by the action of water within a warewashing machine. The softening agent of this invention can be used in detersive compositions prepared from solid, pelletized or particulate warewashing cleaners.

Dishwashing detersive systems typically comprise a source of alkali in the form of an alkali metal hydroxide, alkali metal carbonate, or alkali metal silicate in combination with a hardness sequestering agent, optional surfactants, a source of active halogen, and other optional chemical substances.

The barrier coating and film packet of this invention can be used in a clean-in-place-cleaning environment in which the chemical properties of an aqueous surfactant and a sanitizing agent solution pumped into and through a site requiring cleaning are relied on to the exclusion of mechanical soil removing processes in order to clean pipelines, process equipment, storage tanks, and other enclosed easily soiled locations. Such applications require significant detergency and stability to chemical soils.

Laundry detersive systems typically in the form of particulate or solid compositions can be used in both household and institutional laundry equipment to clean and destain typically soiled fabric articles. Cleaning of such articles is typically accomplished by removing soil that is physically associated with the fabric and by destaining or bleaching soils that cannot be removed by typical detersive systems. Laundry compositions typically comprise anionic or nonionic surfactants, water, softening or hardness sequestering agents, foam stabilizers, pH buffers, soil suspending agents, perfumes, brighteners, opacifiers, and colorants.

The most common degrading components are strong alkaline materials, strong acids, an active chlorine source or mixtures thereof.

The detersive system can be used in hard surface cleaning, hand cleaning, general household cleaning, car washing, recreational equipment cleaning, etc. Such detersive systems are used in the form as shown below or in aqueous solution prepared from the compositions as shown below.

TABLE A

Hard Surface Cleaner Composition

| Component | Useful Wt % | Preferred Wt % | Most Preferred Wt % |
|---|---|---|---|
| Surfactant | 0.1–95 | 0.5–20 | 0.5–10 |
| Sequestering agent | 0.1–40 | 1–30 | 10–30 |
| pH Control agent | 2–99.8 | 5–96 | 10–96 |

TABLE B

C-I-P Composition

| Component | Useful Wt % | Preferred Wt % | Most Preferred Wt % |
|---|---|---|---|
| Source of alkalinity | 5–70 | 10–60 | 20–50 |
| Chlorine source | 0.1–50 | 1–30 | 5–20 |
| Sequestering agent | 1–60 | 2–50 | 3–40 |

TABLE C

Laundry Granular Composition

| Component | Useful Wt % | Preferred Wt % | Most Preferred Wt % |
|---|---|---|---|
| Surfactant | 0.5–50 | 1–40 | 1–25 |
| Source of alkalinity | 0.1–95 | 1–40 | 10–40 |
| Sequestering agent | 1–60 | 2–50 | 2–40 |

TABLE D

General Detersive Composition

| Component | Useful Wt % | Preferred Wt % | Most Preferred Wt % |
|---|---|---|---|
| Source of alkalinity | 0.1–60 | 0.5–50 | 1–40 |
| Surfactant | 0.5–10 | 1–5 | 1–4 |
| Chlorine source | 0–10 | 1–5 | 1–4 |
| Sequestering agent | 1–60 | 2–50 | 3–40 |

Barrier Layer

To protect the water soluble film from breakdown promoted by film degrading components of the detersive system, a barrier coating (having a minimum thickness of 1 micron) is disposed between the detersive system containing the film degrading component and the water soluble film to isolate the film from the active materials. The barrier can be a thin powder coating (preferably less than 40 microns and more preferably about 2 to 10 microns) sufficient to separate the active material from the film or can be a thick encapsulate (5 to 200 microns). The choice of barrier depends on the activity and concentration of the active material. The barrier coating or encapsulate may be disposed on the surface of the detersive system particles by blending or it may simply coat a encapsulate the particles of the film degrading components which must be isolated from the water soluble film.

Powder Coating Barrier

For use in powder coating the particles of the detersive system, a microparticulate powdered soluble composition can be used. These compositions can be inorganic or organic but are preferably water soluble inorganic particulates having a particle size of about 5 to 40 microns and preferably less than about 10 microns. Upon blending of the coating agent with the particles of the detersive system, the microparticles of the agent form a barrier coating on the surface and fill in cracks and fissures of the particulate detersive system. These coating materials must be water soluble at the use pH and temperature of the aqueous cleaning composition formed.

Representative, non-limiting examples of useful microparticulate barrier coating compositions include inorganic salts such as tricalciumphosphate, calcium carbonate, magnesium carbonate hydroxide, magnesium phosphate tribasic and magnesium pyrophosphate. Preferably, the barrier coating is tricalciumphosphate.

To form the barrier coating, the detersive system and barrier coating composition are blended to ensure complete and intimate mixing. This may be done, for example, by charging a ribbon blender with the components of the detersive system and blending until all components are evenly distributed throughout the detersive system. Next, the microfine particles of the barrier coating are added to the blender and allowed to mix with the detersive system until the microparticles of the barrier coating have adhered to the surface of and filled in the surface cracks and fissures of the particulate detersive system. In this manner, sufficient isolation of the detersive system is achieved.

In the powder coating barrier layer aspect of this invention, the powdered coating can be disposed on the entire detersive system which comprises a blend of active ingredients placed in the water soluble container. Disposing the powder coating on each and every particle or pellet of the detersive system prevents or eliminates the undesirable contact between the active film degrading ingredients of the detersive system and the film forming the envelope or container of the detersive system. However, in certain instances, it is necessary only to form the powdered coating barrier around active film degrading components of the detersive system. In such an embodiment, the film degrading components can be introduced into blending equipment and then the powdered or microparticulate barrier material added to the film degrading component to form the powdered barrier. Once coated, the balance of the detersive system can then be directly added to the coating material or the coating material can be added to one or more of-the detersive system ingredients in a separate blending unit and blended adding additional components if necessary until the detersive system is complete.

In the instance that a powdered coating barrier is distributed on the entire detersive system, such detersive systems can contain as much as 20 wt-% of the powdered barrier coating, preferably the detersive system can contain about 0.1 to 20 wt-% of the powdered coating, and most preferably for reasons of high activity of the detersive systems and economy and manufacture, the detersive systems contain 0.5 to 5 wt-% of the powdered coating dispersed on every detersive system particle.

In the instance that the powdered barrier coating is disposed about only the active film degrading components, the powdered barrier coating will comprise no more than about 10 wt-% of the detersive system as a whole, preferably about 0.1 to 5 wt-% of the detersive system and most preferably about 0.5 to 4 wt-% of the detersive system for reasons of high activity and economy and manufacture.

The detersive system comprises encapsulated components which may be film degrading. The detersive system as a whole as an individual component may be encapsulated. In other words, the detersive system particles or pellets may be encapsulated or only those components which may degrade the film can be encapsulated. The encapsulation may be performed in a vessel in which granules of the film degrading component are fluidized by the flow of air through the vessel. A soluble organic encapsulate or an aqueous solution of soluble inorganic materials may then be sprayed onto the fluidized particles until all particles in the bed are completely encapsulated in the fluidized bed. The encapsulate coating may be in the form a single layer or multiple layers of coating material.

The encapsulated film degrading component particles of the present invention can comprise about 50 to 95 wt-% film degrading component and about 5 to 50 wt-% of coating material. In addition multiple coated materials can be employed. When a double coating is employed, the particles can comprise about 50 to 95 wt-% film degrading component core, about 0.5 to 40 wt-% first inorganic coat and about 0.5 to 40 wt-% second coat that is preferably organic.

The coating material must form a solid when dried with a melting point of greater than about 40° C., preferably above about 50° C. Further, the coating should not react with the film degrading component to render it inactive, e.g., an alkaline material should not be coated with an acid.

Preferred organic encapsulates include synthetic detergents. Such detergents include anionic, cationic, nonionic and amphoteric types. The preferred synthetic detergents are anionic. A nonlimiting list of anionic detergents useful in the present invention include the alkyl monomolecular aromatic alkali-metal sulfonates such as the $C_{4-14}$ alkylbenzenesulfonates disclosed in U.S. Pat. No. 2,477,382 (alkyl derived from polypropylene), U.S. Pat. No. 3,370,100 (alkyl derived from a hexene dimer or trimer), and U.S. Pat. No. 3,214,462 (alkyl derived from alphaolefins). Also useful are the primary and secondary alkyl and alkylene sulfates and fatty alcohol sulfates.

A representative, non-limiting list of soluble inorganic materials that can act as an encapsulate include alkalies such as sodium carbonate, sodium bicarbonate, sodium sesquicarbonate, sodium borate, sodium tetraborate, potassium carbonate, potassium bicarbonate, potassium sequicarbonate, potassium borate and potassium tetraborate; phosphates such as forms of mono-, di- and trisodium phosphate, mono-, di- and tripotassium phosphate, anhydrous hydrated diammonium phosphate, monocalcium phosphate monohydrate, tricalcium phosphate, calcium pyrophosphate, iron pyrophosphate, magnesium phosphate, monopotassium orthophosphate, potassium pyrophosphate, disodium orthophosphate dihydrate, trisodium orthophosphate decahydrate, tetrasodium pyrophosphate, sodium tripolyphosphate and sodium phosphate glass; neutral soluble salts such as sodium sulfate and sodium chloride: silicates such as water soluble silicates having an $SiO_2$ to $Na_2O$ ratio of about 1.6:3.2; tetrasodium and tetrapotassium pyrophosphate, pentasodium and pentapotassium tripolyphosphate, anhydrous and hydrated forms of sodium and potassium silicates, sodium trimetaphosphates, sodium borates, sodium and potassium carbonates, bicarbonates, sesquicarbonates, phosphates and polyphosphonates.

When choosing the encapsulating material for use in the present invention, care must be taken to isolate incompatible coating materials from both the film degrading component core and from the film itself. For instance, if anionic synthetic detergents are used, many of these are incompatible with active chlorine sources. Therefore, if it were desired to use such an incompatible coating material, it would be necessary to first coat the active chlorine source core with another material to prevent interaction between the core and a second layer of an anionic synthetic detergent. Preferably, the encapsulate is a single-layered coating comprising a water soluble inorganic coating agent.

The detersive system containing at least one encapsulated component may be prepared by many conventional methods. For example, all detersive system components excepting encapsulated components may be mixed or blended until a uniform composition is achieved throughout the entire detersive system. The encapsulated components are added and mixed last to minimize the damage to the encapsulate.

In either process, water soluble film packets are charged with a pre-determined amount of-the detersive system, and the packets are sealed.

EXAMPLES

The invention may be more fully understood by reference to the following examples which include a best mode.

Example 1

Acid CIP Cleaner Formulated with Tricalciumphosphate

About 96.24 wt-% crystalline sulfamic acid, about 0.25 wt-% sodium sulfonate, 2-imidazoline derivative of caprylic acid, about 0.25 wt-% linear $C_{9-11}$ alcohol, 8.4 mole ethoxylate, about 0.25 wt-% of a surfactant (Plurafac RA-40 available from BASF Wyandotte), and about 0.01 wt-% of an acid blue dye were blended in a ribbon blender until thoroughly mixed. About 3 wt-% of a microfine powdered tricalcium phosphate were added and blended to coat the acid CIP cleaner product.

Example 2

Preparation of Sodium Tripolyphosphate Coated Sodium Metasilicate

About 34.1 parts by weight soft water and about 4.1 parts by weight light density sodium tripolyphosphate were combined to form a coating solution. Into a fluidized bed was placed 20 parts by weight granular, anhydrous sodium metasilicate which was fluidized with air and the bed heated to about 50° to 90° C. The entire amount of the coating solution was sprayed onto the granular sodium metasilicate to form encapsulated sodium metasilicate particles. The fluidized bed was then maintained at about 80° C. to dry the encapsulated particles.

Example 3

Preparation of Sulfate/Carboxymethyl Cellulose Coated Sodium Metasilicate

About 40 parts by weight of soft water and about 6 parts of sodium sulfate were combined to form a first coating solution.

Additionally, about 30 parts of soft water and about 1.5 parts of a sodium carboxymethylcellulose were combined to form a second coating solution.

Into a fluidized bed was placed about 22.5 parts of anhydrous, granular sodium metasilicate which was fluidized with air and the bed heated to about 60° to 90° C. The entire amount of the first coating solution was sprayed onto the granular sodium metasilicate to form encapsulated sodium metasilicate particles. Next, the entire amount of the second coating solution was sprayed onto the encapsulated sodium metasilicate particles. The fluidized bed was then maintained at about 80° C. to dry the doubly encapsulated particles. The finished particles were about 75 wt-% sodium metasilicate, 20 wt- % sodium sulfate and about 5 wt-% carboxymethylcellulose.

Example 4

Encapsulated Halogen Source

A coating solution is formed using about 86 parts soft water and about 6.9 parts low density sodium tripolyphosphate, and about 20.6 parts sodium sulfate. Into a fluidized bed was placed about 76.4 parts granular dichloroisocyanurate dihydrate which was fluidized with air, and the bed was heated to about 45° to 70° C. The entire amount of coating solution was sprayed onto the granular particles to form encapsulated dichloroisocyanurate dihydrate. The bed temperature was then adjusted to about 70° C. and the encapsulated particles were dried. In this drying process about 90 parts of water were driven off from the encapsulated particles.

Example 5

Chlorinated Alkaline CIP Cleaner

About 39.5 wt-% dense sodium carbonate, about 20 wt-% anhydrous granular trisodium phosphate, about 11.25 wt-% light density sodium tripolyphosphate, about 1.9 wt-% of a benzyl ether of a polyethoxylated linear alcohol, about 1.9 wt-% polyoxyethylene polyoxypropylene glycol, about 5.0 wt-% blue granular tripolyphosphate, and about 3.0 wt-% neutralized polyacrylic acid were blended as in Example 1. About 17.5 wt-% of the encapsulated halogen source of Example 4 was added and blended until a uniform composition is formed throughout the detersive system.

Packets were made using 1.5 mil polyvinyl alcohol film (Mono-sol ® 7-000 series film available from Chris Craft Industrial Products, Inc. ) cut to a size of about 8 cm×5 cm. This film was glossy on one side and smooth on the other. The packet was formed from two pieces of film with the glossy sides facing each other. Three edges were sealed ultrasonically. About 20–25 grams of the detersive system was then charged into polyvinyl alcohol film packets which were sealed ultrasonically. These packets were stable under normal storage and handling conditions.

Example 6

Tricalcium Phosphate Coated Alkaline Detersive System

About 25 wt-% parts of granular sodium hydroxide, about 60% of a sodium tripolyphosphate sequestering agent, about 3 wt-% sodium sulfonate, about 1.0 wt-% of a 2-imidazoline derivative of caprylic acid, about 0.5 wt-% linear $C_{9-11}$ alcohol, 8.4 mole ethyoxalate, about 1.0 wt-% surfactant (Plurafac RA-40), and about 0.001 wt-% coloring agent are added to a blender and blended until a homogenous composition is achieved. About 4 wt-% microfine powdered sodium sulfate is added to the blender and mixed to uniformly coat the composition. About 2 wt-% of microfine powdered sulfamic acid is added to the blender and mixed to uniformly coat the composition, and about 4 wt-% microfine powdered tricalcium phosphate is added and mixed to uniformly coat the detersive system. This mixture is charged into polyvinyl alcohol packets as in Example 5. A stable packeted alkaline detersive system results.

Comparative Example A—Acid CIP Cleaner

The process of Example 1 was repeated without adding the tricalcium phosphate to the blender as a barrier coating agent. In this manner, a comparable uncoated Acid CIP was made.

Comparative Example B—Uncoated Sodium Metasilicate

About 80 parts by weight of anhydrous, granular sodium metasilicate was combined with about 20 parts of granular sodium sulfate to form a uniform mixture. The activity of the composition was equivalent to that of the composition of Example 3.

Example 7

Stability of Acid CIP Cleaner Formulations

About 25 grams of the stabilized acid CIP of Example 1 and about 25 grams of the acid CIP of Comparative Example A were each placed in a PVA film packet as in Example 5, sealed and placed in a sealed container and subjected to accelerated test conditions (approximately 50% Relative Humidity at 110° F.) to monitor for stability. The rate of solubility was evaluated according to the number of seconds it took to open until one minute was reached. At one minute, the packet in 2 liters of hot tap water was stirred 25 times. Recorded the amount of product and PVA film remaining, if any, at 4 minutes. The results are shown below in Table E.

TABLE E

| | Unstabilized Acid CIP | Acid CIP with 3.0% Tricalcium Phosphate |
|---|---|---|
| Day 1 | | |
| A. Appearance | OK | — |
| B. Solubility | 6 sec/product and PVA film completely dissolved. | |
| Week 1 | | |
| A. Appearance | OK | OK |
| B. Solubility | 5 sec/product and PVA film completely dissolved. | — |
| Week 2 | | |
| A. Appearance | OK Acetic acid odor | OK Acetic acid odor |
| B. Solubility | 5 sec/product and PVA film completely dissolved. | — |
| Week 3 | | |
| A. Appearance | OK Acetic acid odor | — |
| B. Solubility | 10 sec/product and PVA film completely dissolved. | — |
| Week 4 | | |
| A. Appearance | OK Acetic acid odor | OK Acetic acid odor |
| B. Solubility | 23 sec/product completely dissolved but PVA film remained undissolved. FAIL | 4 sec/product and PVA film completely dissolved. |
| Week 6 | | |
| A. Appearance | | OK Acetic acid odor |
| B. Solubility | | 3 sec/product and PVA film completely dissolved. |
| Week 8 | | |
| A. Appearance | | OK Acetic acid odor |
| B. Solubility | | 8 sec/product and PVA film completely dissolved. |
| Week 10 | | |
| A. Appearance | | OK Acetic acid odor |
| B. Solubility | | 3 sec/product and PVA film completely dissolved. |

From the above data, it is apparent that the use of tricalciumphosphate increases the stability of polyvinyl alcohol film in the presence of acid CIP cleaner formulation.

Example 8

Stability of Coated Sodium Metasilicate

Example 7 was repeated using the coated sodium metasilicate detersive system of Examples 2 and 3 and the uncoated sodium metasilicate Comparative Example B. The results are indicated below in Table F.

TABLE F

| | Uncoated Sodium Metasilicate | Cellulose Coated Sodium Metasilicate | Tripolyphosphate Coated Sodium Metasilicate |
|---|---|---|---|
| Day 1 | | | |

TABLE F-continued

| | Uncoated Sodium Metasilicate | Cellulose Coated Sodium Metasilicate | Tripolyphosphate Coated Sodium Metasilicate |
|---|---|---|---|
| A. Appearance | OK | | |
| B. Solubility | 12 sec/product completely dissolved but a piece PVA film remained undissolved. FAIL | | |
| Week 1 | | | |
| A. Appearance | | OK | OK |
| B. Solubility | | 11 sec/PVA film completely dissolved. | 11 sec/product and PVA film completely dissolved. |
| Week 2 | | | |
| A. Appearance | | OK | OK |
| B. Solubility | | 22 sec/PVA film completely dissolved. | 10 sec/product and PVA film completely dissolved. |
| Week 3 | | | |
| A. Appearance | | OK | OK |
| B. Solubility | | 14 sec/PVA film completely dissolved.16 sec/product and PVA film completely dissolved. | |
| Week 4 | | | |
| A. Appearance | | OK | OK |
| B. Solubility | | 7 sec/PVA film completely dissolved. | 10 sec/product completely dissolved but a piece of PVA film remained undissolved. FAIL |
| Week 5 | | | |
| A. Appearance | | OK | |
| B. Solubility | | 18 sec/product completely dissolved but a piece of PVA film remained undissolved. FAIL | |

The above data illustrates that using the coating according to our invention improves the stability of polyvinyl alcohol films in the presence of sodium metasilicate compositions.

Example 9

Stability of PVA Films in the Presence of Halogen Cleaning Compositions

Example 7 was repeated using the cleaning composition of Example 4 and that of Comparative Example C. The results are shown below in Table G.

TABLE G

| | Uncoated CDB-56 | Coated CDB-56 |
|---|---|---|
| Day 1 | | |
| A. Appearance | OK | OK |
| B. Solubility | Packet did not open in one minute/PVA film remained undissolved. FAIL | 6 sec/product and PVA film completely dissolved. |
| Week 1 | | |
| A. Appearance | | OK |

TABLE G-continued

| | Uncoated CDB-56 | Coated CDB-56 |
|---|---|---|
| B. Solubility | | 7 sec/product and PVA film completely dissolved. |
| Week 2 | | |
| A. Appearance | | OK |
| B. Solubility | | 16 sec/product and PVA film completely dissolved. |
| Week 3 | | |
| A. Appearance | | OK |
| B. Solubility | | Packet did not open in one minute/PVA film remained undissolved. FAIL |

The above data indicate that encapsulating halogen sources according to the invention improves the stability of polyvinyl alcohol films in the presence of cleaning compositions containing halogen sources.

This specification, examples and data presented above are intended to aid in complete, nonlimiting understanding of the invention. Since many variations and embodiments can be made without parting from the spirit and scope of the invention, the invention resides in the claims hereinafter appended.

What is claimed is:

1. A detersive system contained within a water soluble package comprising:
(a) About 80 to 99.5 wt.-% of a water soluble film package;
(b) A detersive system comprising at least one strongly acidic film degrading component; and
(c) About 0.5 to 20 wt.-% of a water soluble barrier coating;
wherein the water soluble barrier coating is disposed about and adheres to the film degrading component to prevent the film degrading component from promoting film degradation and the water soluble barrier coating comprises a particulate material having an average particle size of less than about 200 microns.

2. The system of claim 1 wherein the water soluble film comprises a polyvinyl alcohol film.

3. The system of claim 2 wherein the polyvinyl alcohol film comprises a polyvinyl alcohol which is about 86 to 89% hydrolysed.

4. The system of claim 2 wherein the polyvinyl alcohol film comprises a polyvinyl alcohol having a molecular weight of about 10,000 to 200,000.

5. The system of claim 1 wherein the water soluble barrier coating comprises an inorganic salt.

6. The system of claim 1 wherein the water soluble barrier coating comprises a particulate material having a particle size of about 2 to 40 microns.

7. The system of claim 1 which further comprises a moisture impervious outerwrap which essentially prevents moisture or water from contacting the water soluble packet before the packet's removal from the outerwrap.

8. A water soluble package detersive system comprising:
(a) a sealed package comprising a water soluble film;
(b) about 80 to 99.5 wt-% of a detersive system containing an acidic film degrading component comprising a strong acid; and
(c) about 0.5 to 20 wt-% of a water soluble powder barrier coating comprising a basic inorganic salt;
wherein the detersive system is held within the package and the water soluble barrier coating is disposed upon and adheres to the surface of the acidic film degrading component to prevent the degradation of the film and the water soluble powder has an average particle size of less than about 40 microns.

9. The system of claim 8 wherein the water soluble film comprises a polyvinyl alcohol film.

10. The system of claim 9 wherein the polyvinyl alcohol film comprises a polyvinyl alcohol having a degrading hydration of 86 to 89% and a molecular weight of about 10,000 to 200,000.

11. The system of claim 8 wherein the water soluble barrier coating comprises an alkali metal phosphate salt..

12. The system of claim 8 wherein the water soluble barrier coating comprises a tricalciumphosphate particulate material.

13. The system of claim 8 which further comprises a moisture impervious outerwrap covering the package which essentially prevents moisture or water from contacting the water soluble film before the removal of the outerwrap.

14. A method for producing a stable, water soluble packaged detersive system, which method comprises:
(a) forming a detersive system comprising at least one strongly acidic film degrading component having a water soluble barrier coating;
(b) charging the packet with the detersive system;
(c) sealing the packet to completely enclose the detersive system;
wherein the water soluble barrier coating is disposed upon and adheres to the surface of the film degrading component to prevent film degradation and the water soluble barrier coating comprises a particulate material having an average particle size of less than about 200 microns.

15. The method of claim 14 comprising separating the film degrading component from the film wherein the water soluble barrier coating is disposed solely on the film degrading component.

16. The method of claim 14 comprising separating the film degrading component from the packet wherein the water soluble barrier coating is disposed on the detersive system.

17. The method of claim 14 wherein the water soluble barrier coating comprises an inorganic salt.

18. The method of claim 14 wherein the water soluble film comprises a poly(vinyl alcohol) film.

19. The method of claim 14 comprising water sealing the packet to completely enclose the detersive system.

20. A method for producing a stable, water soluble packaged detersive system, which method comprises:
(a) forming a film degrading detersive system comprising a strongly acid;
(b) coating the detersive system with a water soluble barrier coating;
(c) charging a packet comprising a water soluble film with the coated detersive system; and
(d) sealing the packet to completely enclose the coated detersive system;
wherein the water soluble barrier coating is disposed upon and adheres to the surface of the film degrading component to prevent film degradation and the water soluble barrier coating comprises a particulate material having an average particle size of less than about 200 microns.

21. The method of claim 20 wherein the water soluble barrier coating comprises a particulate material having a particle size up to about 40 microns.

22. The method of claim 20 wherein the water soluble barrier coating comprises an inorganic salt.

23. The method of claim 22 wherein the water soluble barrier coating comprises tricalcium phosphate, calcium carbonate, magnesium carbonate hydroxide, magnesium phosphate tribasic, magnesium pyrophosphate or mixtures thereof.

24. The method of claim 22 wherein the water soluble barrier coating comprises tricalcium phosphate.

25. The method of claim 20 comprising water sealing the packet to completely enclose the detersive system.

26. A method for producing a stable, water soluble package detersive system, which method comprises:
(a) coating at least one film degrading component comprising a strong acid with a water soluble barrier coating;
(b) forming a powdered, detersive system comprising the coated film degrading component;

(c) charging a packet comprising a water soluble film with the detersive system; and (d) sealing the packet to completely enclose the coated detersive system;

wherein the water soluble barrier coating is disposed upon and adheres to the surface of the film degrading component to prevent film degradation and the water soluble barrier coating comprises a particulate matter having an average particle size of less than about 200 microns.

27. The method of claim 26 wherein the water soluble barrier coating comprises an inorganic salt.

28. The method of claim 26 wherein the water soluble film comprises a poly(vinyl alcohol) film.

29. The method of claim 26 comprising heat sealing the packet to completely enclose the detersive system.

* * * * *

UNITED STATES PATENT AND TRADEMARK OFFICE
CERTIFICATE OF CORRECTION

PATENT NO. : 5,384,364

DATED : January 24, 1995

INVENTOR(S) : Besse et al.

It is certified that error appears in the above-identified patent and that said Letters Patent is hereby corrected as shown below:

Title page,
In item (75), line Inventors, please delete "Keith E. Olson, Apple Valley," after the word "St. Paul;"

Title page,
In item (75), please delete "all" and substitute therefore --both of Minn.--

On column 7, line 24, please insert --in-- after the word "useful"

On column 9, line 9, please delete "a" and substitute therefore --and--

On column 9, lines 29 and 32, please delete "tricalciumphosphate" and substitute therefore --tricalcium phosphate--

On column 10, line 67, please delete "seqicarbonate" and substitute therefore --sesquicarbonate--

On column 11, line 50, please delete "Tricalciumphosphate" and substitute therefore --Tricalcium Phosphate--

On column 13, line 16, please delete "homogenous" and substitute therefore --homogeneous--

On column 17, line 64 (claim 12), please delete "tricalciumphosphate" and substitute therefore --tricalcium phosphate--

On column 17, before line 10 (claim 1), please insert --(a) A water soluble film package;-- after the word "comprising:"

UNITED STATES PATENT AND TRADEMARK OFFICE
CERTIFICATE OF CORRECTION

PATENT NO. : 5,384,364

DATED : January 24, 1995

INVENTOR(S) : Besse et al.

It is certified that error appears in the above-identified patent and that said Letters Patent is hereby corrected as shown below:

On column 17, line 10 (claim 1), please delete "(a)" and substitute therefore --(b)--

On column 17, lines 10, 11 and 12 (claim 1), please delete "water soluble film package; (b) A" after the letter "a"

Signed and Sealed this

Twentieth Day of June, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,384,364
DATED : January 24, 1995
INVENTOR(S) : Besse et al.

It is certified that error appears in the above-identified patent and that said Letters Patent is hereby corrected as shown below:

Column 17, claim 1,
Line 10, delete " About 80 to 99.5 wt.-% of"
Line 10, "a water" should read -- A water --
Line 12, insert -- About 80 to 99.5 wt.-% of -- before "A detersive"
Line 12, "A detersive" should read -- a detersive --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*